US008735035B2

(12) United States Patent
Lee et al.

(10) Patent No.: US 8,735,035 B2
(45) **Date of Patent: *May 27, 2014**

(54) ELECTROPHOTOGRAPHIC TONER AND PROCESS OF PREPARING THE SAME

(75) Inventors: Ju-yeon Lee, Suwon-si (KR); Jun-young Lee, Seoul (KR); Kyeong Pang, Suwon-si (KR); Tae-hoe Koo, Suwon-si (KR); Su-bum Park, Nam-gu (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 13/355,117

(22) Filed: Jan. 20, 2012

(65) Prior Publication Data

US 2012/0189952 A1 Jul. 26, 2012

(30) Foreign Application Priority Data

Jan. 21, 2011 (KR) ..... 10-2011-0006490

(51) Int. Cl.
*G03G 9/00* (2006.01)

(52) U.S. Cl.
USPC ..... 430/108.7; 430/110.3

(58) Field of Classification Search
USPC ..... 430/108.1, 108.7, 110.3, 108.3, 108.5, 430/109.1, 109.3
See application file for complete search history.

(56) References Cited

U.S. PATENT DOCUMENTS

| | | | | |
|---|---|---|---|---|
| 5,972,553 | A * | 10/1999 | Katada et al. | 430/108.23 |
| 2010/0159379 | A1* | 6/2010 | Lee et al. | 430/108.7 |
| 2012/0064450 | A1* | 3/2012 | Pang et al. | 430/109.1 |
| 2012/0202149 | A1* | 8/2012 | Lee et al. | 430/108.5 |
| 2012/0214096 | A1* | 8/2012 | Pang et al. | 430/108.4 |

FOREIGN PATENT DOCUMENTS

| | | |
|---|---|---|
| JP | 2002-6553 | 1/2002 |
| KR | 10-0282314 | 12/1994 |
| KR | 10-2004-0105240 | 12/2004 |

OTHER PUBLICATIONS

Office Action dated Jan. 3, 2013 in co-pending U.S. Appl. No. 13/233,204.
Office Action dated Jun. 10, 2013 in co-pending U.S. Appl. No. 13/233,204.

* cited by examiner

*Primary Examiner* — Stewart Fraser
(74) *Attorney, Agent, or Firm* — Staas & Halsey LLP

(57) ABSTRACT

An electrophotographic toner and a process for preparing the same. The electrophotographic toner includes a binder, a coloring agent, and a release agent. The binder includes two resins having different weight average molecular weights.

5 Claims, 2 Drawing Sheets

ELECTROPHOTOGRAPHIC TONER AND PROCESS OF PREPARING THE SAME

CROSS-REFERENCE TO RELATED APPLICATIONS

This application claims the benefit of Korean Patent Application No. 10-2011-0006490, filed on Jan. 21, 2011, in the Korean Intellectual Property Office, the disclosure of which is incorporated herein in its entirety by reference.

BACKGROUND

1. Field

The present disclosure relates to an electrophotographic toner and a process of preparing the same.

2. Description of the Related Art

In electrophotographic processes or electrostatic recording processes, developers for developing electrostatic images or electrostatic latent images are classified into two-component developers formed of a toner and carrier particles, and one-component developers substantially formed of only a toner, that is, developers that are not formed of carrier particles. The one-component developers may be classified into magnetic one-component developers containing a magnetic component, and nonmagnetic one-component developers not containing a magnetic component. Plasticizers such as colloidal silica may be often independently added to nonmagnetic one-component developers to improve toner fluidity. In general, coloring particles obtained by dispersing a coloring agent, such as carbon black, or other additives in a latex are used as a toner.

Toners may be prepared using a pulverization method or a polymerizing method. In the pulverization method, a synthesized resin, a coloring agent, and when required, other additives are melted, pulverized, and then sorted to obtain particles having desired diameters, to thereby obtain a toner. In the polymerizing method, a coloring agent, a polymerization initiator, and when required, other additives, such as a crosslinking agent or an antistatic agent, are uniformly dissolved in or dispersed into a polymerizable monomer to prepare a polymerizable monomer composition. Then, the polymerizable monomer composition is dispersed into an aqueous dispersion medium including a dispersion stabilizer, using a stirrer to form micro droplet particles of the polymerizable monomer composition. Subsequently, a temperature of the mixture of the medium and the micro droplet particles is increased and then a suspension polymerization process is performed to obtain colored polymerization particles having desired diameters, to thereby obtain a polymerized toner.

Toners used for image forming apparatuses are mainly prepared through a pulverization method. In the pulverization method, since a toner particle size, a geometric size distribution, and a toner structure are not accurately controlled, it is difficult to independently adjust important characteristics required for a toner, such as charging, fixation, fluidity, and storability.

A polymerized toner having an easily obtained particle diameter does not require a complex manufacturing process, such as classification, has recently received a great amount of attention. By using such a polymerization method, a toner having a desired particle diameter and a desired particle diameter distribution may be prepared without pulverization and classification. In order to uniformly control geometric sizes or shapes during a polymerization process, a coagulating method has been suggested as a toner preparing process that uses a metallic salt, such as $MgCl_2$ and NaCl, or a polymer such as poly aluminium chloride (PAC).

If a metallic salt coagulant is used, geometric sizes and particle distribution of a toner can be controlled and capsule structures having shells can be constructed to some degree of reproducibility, and thus a metallic salt coagulant may be put to practical use in toner formation. However, there are limitations in uniform control of geometric sizes and shapes. That is, although the granularity of a toner can be well controlled in a central toner particle size range, the shape of toner particles tends to be undesirably spherical in a small toner particle range. This may cause an issue in regard to blade cleaning during electrophotographic processes.

Additionally, a toner having both a high gloss and a wide fixation region can be prepared by controlling a coagulating process during formation of the toner so that the toner have a capsule structure. In the case of a toner having a capsule structure, since a pigment and a release agent are not exposed, charging uniformity, fluidity, and heat storability may be ensured to some degree. An anti-offset characteristic of a toner is important for ensuring stable fixation of the toner and is closely related to rheological properties of the toner. Properties of a toner such as molecular weight and crosslinking, or use of a release agent are considered to control the anti-off characteristic of the toner.

SUMMARY

Additional aspects and/or advantages will be set forth in part in the description which follows and, in part, will be apparent from the description, or may be learned by practice of the invention.

According to an aspect of the present disclosure, there is provided an electrophotographic toner including a binder with two resins having respectively different weight average molecular weights, a coloring agent, and a release agent, wherein the toner has, on a Gel Permeation Chromatography (GPC) chromatogram, a molecular weight distribution curve including a main peak in a region of about $8.0\times10^3$ g/mol to about $4.0\times10^4$ g/mol and a shoulder starting point in a region equal to or greater than about $1.0\times10^5$ g/mol; the toner has a weight average molecular weight of about $5.0\times10^4$ g/mol to about $4.0\times10^5$ g/mol and a Z average molecular weight of about $1.0\times10^5$ g/mol to about $6.0\times10^6$ g/mol; an average circularity of the toner is about 0.960 to about 0.985; a coefficient of variation (C.V) of the average circularity of the toner is about 1.5% to about 3.3%; and the toner has a Brunauer, Emmett & Teller (BET) surface area of about 1.5 $m^2/g$ to about 3.5 $m^2/g$.

The toner may further comprise about $1.0\times10^3$ ppm to about $1.0\times10^4$ ppm of iron (Fe) and about $1.0\times10^3$ ppm to about $5.0\times10^3$ ppm of silicon (Si).

A ratio of sulfur strength [S] to iron strength ([S]/[Fe]) measured by fluorescence x-ray in the toner may be within about $5.0\times10^{-4}$ to about $5.0\times10^{-2}$.

A volume average particle diameter of the toner may be about 4.0 μm to about 9.0 μm.

The toner may have a GSDp value of about 1.0 to about 1.35 and a GSDv value of about 1.0 to about 1.3.

According to another aspect of the present disclosure, there is provided a method of preparing the above-stated electrophotographic toner according to the present disclosure, the method including: preparing a mixture by mixing a primary binder with two resin latexes having respectively different weight average molecular weights, a coloring agent dispersion, and a release agent dispersion; preparing core layer particles by adding a coagulant solution to the mixture; and preparing toner particles by coating the core layer particles with shell layer particles, the shell layer particles including secondary binder particles prepared by polymerizing at least one polymerizable monomer.

The two resin latexes may include a low molecular weight resin latex having a weight average molecular weight of about $1.3\times10^4$ g/mol to about $3.0\times10^4$ g/mol and a high molecular weight resin latex having a weight average molecular weight of about $1.0\times10^5$ g/mol to about $5.0\times10^6$ g/mol.

A weight ratio of the low molecular weight resin latex to the high molecular weight resin latex may be about 99:1 to about 70:30.

The preparing of the toner particles may include: coagulating the core layer particles and the shell layer particles in a temperature range in which a shear storage modulus (G') of the core layer particles and the shell layer particles is about $1.0\times10^8$ Pa to about $1.0\times10^9$ Pa; stopping the coagulating of the core layer particles and the shell layer particles when an average diameter of the coagulated particles prepared during the coagulating becomes about 70% to about 100% of an average diameter of the toner particles; and fusing and unifying the coagulated particles obtained after the stopping of the coagulating, in a temperature range in which a shear storage modulus (G') of the coagulated particles is about $1.0\times10^4$ Pa to about $1.0\times10^9$ Pa.

The method may further include coating tertiary binder particles on the toner particles prepared by coating the core layer particles with the shell layer particles.

The release agent dispersion may include a paraffin-based wax and an ester-based wax.

A content of the ester-based wax may be about 1 wt % to about 35 wt % based on a total weight of the paraffin-based wax and the ester-based wax.

The coagulant may include a metallic salt including Si and Fe.

The coagulant may include Fe-polysilicate.

The coagulant solution may have a pH equal to or less than about 2.0.

BRIEF DESCRIPTION OF THE DRAWINGS

The above and other features and advantages of the present disclosure will become more apparent by describing in detail exemplary embodiments thereof with reference to the attached drawings in which.

DETAILED DESCRIPTION

Figure 1:
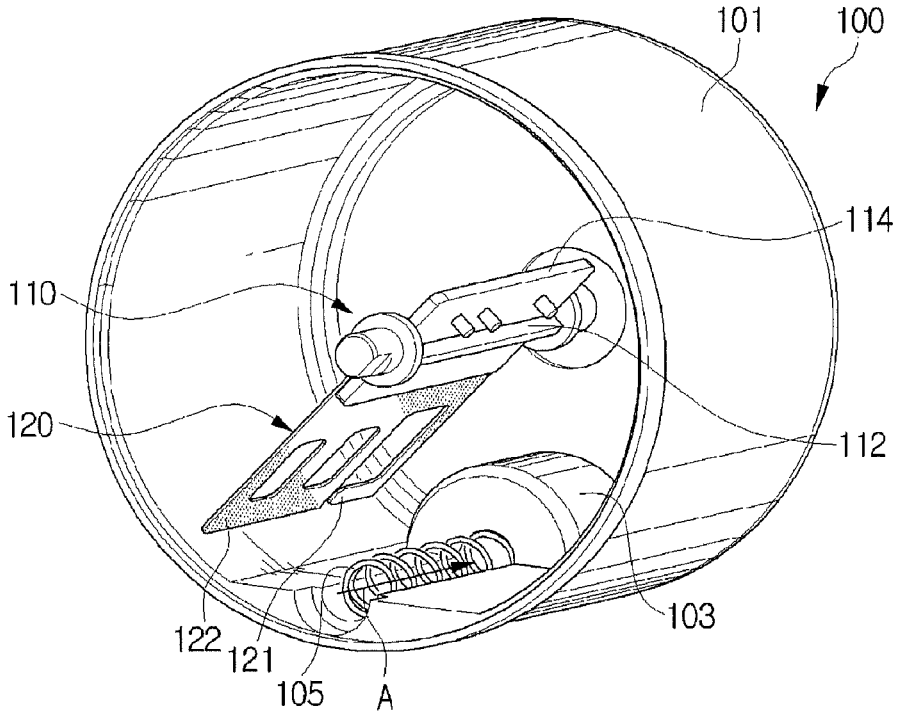
FIG. 1 schematically illustrates a toner supplying apparatus according to an embodiment of the present disclosure.

Reference will now be made in detail to the embodiments, examples of which are illustrated in the accompanying drawings, wherein like reference numerals refer to the like elements throughout. The embodiments are described below to explain the present invention by referring to the figures.

An electrophotographic toner according to the present disclosure includes a binder with two resins having different weight average molecular weights, a coloring agent, and a release agent. The electrophotographic toner has, on a Gel Permeation Chromatography (GPC) chromatogram, a molecular weight distribution curve with a main peak in a region of about $8.0\times10^3$ g/mol to about $4.0\times10^4$ g/mol and a shoulder starting point in a region of about $1.0\times10^5$ g/mol or more. Also, the electrophotographic toner has a weight average molecular weight of about $5.0\times10^4$ g/mol to about $4.0\times10^5$ g/mol and a Z average molecular weight of about $1.0\times10^5$ g/mol to about $6.0\times10^6$ g/mol. The electrophotographic toner has an average circularity of about 0.960 to about 0.985. A coefficient of variation (C.V) of the average circularity is about 1.5% to about 3.3%. The electrophotographic toner has a Brunauer, Emmett & Teller (BET) surface area of about 1.5 $m^2/g$ to about 3.5 $m^2/g$.

A molecular weight of a toner influences gloss and fixation of the toner, and a molecular weight distribution of a binder formed of a polymer resin almost corresponds to a molecular weight distribution of a toner including the binder.

Accordingly, when a one-component binder resin is used, a molecular weight distribution curve of a toner including the binder resin forms one normal distribution curve. However, when a two-component binder resin including a resin having a relatively low molecular weight and a resin having a relatively high molecular weight, a main distribution curve of a molecular weight of a toner including the two-component binder resin may be formed in a region corresponding to a molecular weight distribution of the low molecular weight resin, and a distribution curve having a relatively slow slope (i.e., shoulder) linked to an edge of the main distribution curve, which has a relatively rapid slope, may be formed in a region corresponding to a molecular weight distribution of the high molecular weight resin. If a content of the high molecular weight resin is unnecessarily high, a double-peak shape is formed. In this case, although allowable anti-offset may be obtained, high gloss may not be obtained.

When a toner is prepared using an appropriate amount of binder including two resins having different molecular weights, each resin may independently function. That is, molecular entanglement does not occur in a relatively low molecular weight resin having a molecular weight equal to or less than a critical molecular weight, and thus the relatively low molecular weight resin may function in terms of minimum fixing temperature (MFT) and gloss. On the contrary, more molecular entanglement occurs in a relatively high molecular weight resin, and thus the relatively high molecular weight resin may have predetermined elasticity even at a high temperature, thus contributing to anti-offset property. Therefore, using a binder including two resins having different molecular weights allows of rheological designs for toner.

For example, a maximal point (i.e., main peak) of a main curve of the molecular weight distribution of the electrophotographic toner is in a range of about $8\times10^3$ g/mol to about $4.0\times10^4$ g/mol, about $1.0\times10^4$ g/mol to about $3.5\times10^4$ g/mol, or about $1.3\times10^4$ g/mol to about $2.5\times10^4$ g/mol. If the main peak is within the above range, melt viscosity of the toner is improved, and thus gloss and fixation are improved.

Additionally, the molecular weight distribution curve of the electrophotographic toner drops with a steep slope from an apex of the main peak and then goes into a gentle upward-slope portion. Thus, a point of inflection on the molecular weight distribution curve where a main distribution curve ends and the slow upward-slope portion starts is defined as a shoulder starting point.

For example, the shoulder starting point may be formed in a range of equal to or greater than about $1.0\times10^5$ g/mol, in a range of about $1.5\times10^5$ g/mol to about $5.0\times10^6$ g/mol, or in a range of about $2.0\times10^5$ g/mol to about $4.5\times10^6$ g/mol.

If the shoulder starting point is within the above ranges, anti-offset of the toner is improved at high temperatures and thus a broader fixation region is obtained and gloss and durability are improved.

The weight average molecular weight of the electrophotographic toner is, for example, in a range of about $5.0\times10^4$ g/mol to about $4.0\times10^5$ g/mol, about $6.0\times10^4$ g/mol to about $2.0\times10^5$ g/mol, or about $6.5\times10^4$ g/mol to about $1.5\times10^5$ g/mol, and the Z average molecular weight of the electrophotographic toner is, for example in a range of about $1.0\times10^5$ g/mol to about $6.0\times10^6$ g/mol, about $8.0\times10^5$ g/mol to about $5.5\times10^6$ g/mol, or about $1.5\times10^6$ g/mol to about $5.0\times10^6$ g/mol.

When the toner has a weight average molecular weight equal to or greater than about $5.0\times10^4$ g/mol, durability may be improved and blocking may be more suppressed in terms of high temperature preservability. When the toner has a weight average molecular weight equal to or less than about $4.0\times10^5$ g/mol, improved fixation characteristics may be maintained.

A Z average molecular weight of a toner typically represents a polymer distribution in a molecular weight distribution, and this distribution is important since it reflects toughness of the toner fused during exfoliation. When the electrophotographic toner has a Z average molecular weight of about $1.0\times10^5$ g/mol to about $6.0\times10^6$ g/mol, the toner may have improved anti-offset and gloss.

In terms of various toner characteristics, toner shapes and toner shape distributions are important. In case of a toner having an indeterminate particle shape, transferability and fluidity may be poor, and development durability may be poor due to stress between toner particles. On the contrary, in case of a toner having spherical particle shape, tribo-charging may be poorly carried out and cleaning may be relatively difficult. When the shape distribution of a toner is broad, image durability may be reduced at the end of a warranty period of the toner because of selective development caused by a widened charge distribution.

Additionally, toner surface features affect toner characteristics. As the surface roughness of a toner increases, the toner may be easily influenced by surrounding environments and thus charging stability of the toner may be reduced much more by the influence of surrounding environments. On the other hand, as the roughness of a toner decreases, frictional charging may be difficult because the surface area of the toner decreases. Therefore, it may be necessary to find a shape, a shape distribution, and a surface area range that satisfy all of charging, development, fluidity, and cleaning requirements.

A circularity of a toner may be measured using FPIA-3000 equipment of SYSMEX Corporation and may be calculated by the following equation.

$$\text{Circularity}=2\times(\pi\times\text{area})^{0.5}/\text{circumference} \qquad \text{<Equation>}$$

The circularity ranges from 0 to 1, and the circularity of an object approaches 1, the object becomes more circular.

The average circularity of the electrophotographic toner according to an aspect of the present disclosure may be, for example, in a range of about 0.960 to about 0.985, about 0.964 to about 0.980, or about 0.967 to about 0.977.

When the average circularity of the electrophotographic toner is equal to or greater than about 0.960, the height of an image developed using the electrophotographic toner on a transfer medium may be appropriate, and thus toner consumption may be reduced. In addition, since gaps between particles of the electrophotographic toner may not be largely increased, the sufficient coverage of the image may be obtained. Furthermore, in a developing unit, stress between toner particles of the electrophotographic toner may be reduced as compared with the case of a toner having an indeterminate particle shape, and thus an improved development durability may be ensured. When the average circularity of the electrophotographic toner is equal to or less than about 0.985, the toner may be prevented from being excessively supplied to a development sleeve, thereby preventing contamination due to the sleeve being coated unevenly by the toner. In addition, the toner may be more easily cleaned by a cleaning blade as compared with a toner having a circular particle shape.

For example, the coefficient of variation (C.V) of the average circularity of the electrophotographic toner may be in a range of about 1.5% to about 3.3%, about 1.7% to about 3.0%, or about 1.9% to about 2.7%.

A coefficient of variation of an average circularity of a toner is an index representing the area of an average circularity distribution of the toner and is calculated using the following equation.

$$\text{Coefficient of variation}=(S1/K)\times100 \qquad \text{[Equation]}$$

where S1 represents a standard deviation of circularities of 100 toner particles and K represents an average value of the circularities.

In order to uniformly control an average circularity of a toner and a coefficient of variation of the average circularity without a change according to batch lots, an appropriate process ending time may be determined while monitoring characteristics of coagulating particles formed during the unifying process. A monitoring method is not particularly limited but may use an "FPIA-3000" (manufacturer: SYSMEX Corporation), i.e., a flow type particle shape analyzing apparatus. That is, during the unifying process, a sample is taken and diluted in a particle sheath solution and a shape is measured through the FPIA, and when a desirable shape is obtained, reactions are stopped.

If the coefficient of variation of the average circularity of the electrophotographic toner is within a range of about 1.5% to about 3.3%, a frictional charging distribution of the toner is narrow and charging stability thereof with respect to time can be improved. As a result, transfer efficiency may be maintained over time. Thus, high image quality may be guaranteed even at the end of a warranty period. In addition, scattering of the toner particles may be suppressed.

The BET surface area of the electrophotographic toner is for example, about 1.5 $m^2/g$ to about 3.5 $m^2/g$, about 1.7 $m^2/g$ to about 3.2 $m^2/g$, or about 2.0 $m^2/g$ to about 3.0 $m^2/g$.

If the BET surface area of the electrophotographic toner is within the above ranges, compared to having a BET surface area of more than about 3.5 $m^2/g$, a charging value of the toner is more rapidly increased by friction charging and charging stability is more securely obtained. If the BET surface area of the electrophotographic toner is within the above ranges, compared to having a BET surface area of less than about 1.5 $m^2/g$, the toner is not sensitive to changes of surrounding environments, such as changes in temperature and humidity, and thus charging and fluidity in high temperature and high humidity environments can be more improved.

The electrophotographic toner may further comprise iron (Fe) and silicon (Si). A content of Fe may be, for example, about $1.0\times10^3$ ppm to about $1.0\times10^4$ ppm, about $2.0\times10^3$ ppm to about $0.8\times10^4$ ppm, or about $4.0\times10^3$ ppm to about $0.6\times10^4$ ppm. A content of Si may be, for example, about $1.0\times10^3$ ppm to about $5.0\times10^3$ ppm, about $1.5\times10^3$ ppm to about $4.5\times10^3$ ppm, or about $2.0\times10^3$ ppm to about $4.0\times10^3$ ppm.

When the contents of Fe and Si are within the above ranges, charging of the electrophotographic toner may be improved and contamination inside a printer may be prevented.

An iron strength [Fe], a silicon strength [Si], and a sulfur strength [S] in the electrophotographic toner, which are measured by fluorescence x-ray, may be such that [Si]/[Fe] is within about $5.0\times10^{-4}$ to about $5.0\times10^{-2}$ and [S]/[Fe] is within about $5.0\times10^{-4}$ to about $5.0\times10^{-2}$.

The iron strength [Fe] corresponds to a content of iron in a coagulant used for coagulating a latex, a coloring agent, and a release agent while a toner is being prepared. Thus, the iron strength [Fe] may influence a coagulation degree, a particle size distribution, and a particle size of a coagulated toner which is a precursor for preparing a final toner.

The silicon strength [Si] is a value corresponding to a content of silicon in a coagulant used during toner preparation or silicon in silica particles externally added to obtain toner fluidity. Thus, like the iron strength [Fe], the silicon strength [Si] may also influence a coagulation degree, a particle size distribution, and a particle size of a coagulant coagulated toner. And, the silicon strength [Si] may also influence toner fluidity.

A ratio of the silicon strength [Si] to the iron strength [Fe] (i.e., [Si]/[Fe]) may be, for example, about $5.0\times10^{-4}$ to about $5.0\times10^{-2}$, about $8.0\times10^{-4}$ to about $3.0\times10^{-2}$, or about $1.0\times10^{-3}$ to about $1.0\times10^{-2}$.

When [Si]/[Fe] is within about $5.0\times10^{-4}$ to about $5.0\times10^{-2}$, the toner may have a properly controlled amount of externally-added silica. Thus, toner fluidity may be more improved, and contamination inside a printer may be more effectively prevented.

The sulfur strength [S] is a value corresponding to a sulfur content contained in a chain transfer agent used to adjust a molecular weight distribution of a latex of a toner while the latex is being prepared. If the sulfur strength [S] is relatively large when preparing a latex, a molecular weight of the latex is reduced since new chains are introduced, and if the sulfur strength [S] is relatively small when preparing a latex, chain growth continues and thus a molecular weight of the latex is increased.

When [S]/[Fe] is within a range of about $5.0\times10^{-4}$ to about $5.0\times10^{-2}$, coagulation and charging properties are improved. Thus, a toner having an appropriate molecular weight, an appropriate particle size distribution, and an appropriate particle size may be provided.

A volume average particle diameter of the electrophotographic toner may be, for example, in a range of about 4.0 μm to about 9.0 μm, about 4.5 μm to about 8.7 μm, or about 5.0 μm to about 8.5 μm.

Generally, as a toner particle becomes smaller, higher resolution and higher image quality are obtained, but transfer speed and cleaning ability get poorer. Therefore, it may be important for a toner to have an appropriate particle diameter.

A volume average particle diameter of a toner may be measured through an electrical resistance method.

When the volume average particle diameter of the electrophotographic toner is equal to or greater than about 4.0 μm, photoconductor cleaning is easy, a production yield is improved, an issue regarding the toner particles scattering, which is harmful to humans, is prevented, and an image of a high resolution and a high quality is obtained. When the volume average particle diameter of the electrophotographic toner is equal to or less than about 9.0 μm, charging is uniform and fixation of the toner is improved. Also, it becomes easier for a Dr-Blade to control a toner layer.

A volume average particle size distribution index GSDv or a number average particle size distribution index GSDp may be used for representing a toner particle size distribution, and may be measured and calculated as will be described below.

First, a particle size distribution of a toner, measured using a Coulter Counter Multisizer III instrument (manufacturer: Beckman Coulter company), is divided into particle size ranges (i.e., channels) and then an cumulative distribution of volume or number of toner particles in the channels is drawn, in a direction of from small diameter to large diameter of the toner particles. On the accumulation distribution, a diameter of 16% accumulation is defined as a volume average particle size D16v or as a number average particle size D16p, and a diameter of 50% accumulation is defined as a volume average particle size D50v or as a number average particle size D50p. In the same manner, a diameter of 84% accumulation on the accumulation distribution is defined as a volume average particle size D84v or as a number average particle size D84p.

Further, the volume average particle size distribution index GSDv is defined as $(D84v/D16v)^{0.5}$ and the number average particle size distribution index GSDp is defined as $(D84p/D16p)^{0.5}$.

A GSDp value of the electrographic toner may be, for example, about 1.0 to about 1.35, about 1.15 to about 1.30, or about 1.20 to about 1.25. A GSDv value of the electrographic toner may be, for example, about 1.0 to about 1.3, about 1.15 to about 1.27, or about 1.20 to about 1.25. If values of the GSDv and the GSDp of the electrographic toner are within the above ranges, the toner may have a uniform particle diameter.

According to another aspect of the present disclosure, a method of preparing an electrophotographic toner includes: preparing a mixture by mixing primary binder particles comprising two different resin latexes having different weight average molecular weights from each other, a coloring agent dispersion, and a release agent dispersion; forming core layer particles by adding a coagulant solution to the mixture; and preparing toner particles by coating the core layer particles using shell layer particles including secondary binder particles prepared by polymerizing at least one polymerized monomer, wherein: the electrophotographic toner comprises a binder comprising two resins having different weight average molecular weights from each other, a coloring agent, and a release agent; the electrophotographic toner has a molecular weight distribution curve including a main peak in a region of about $8.0\times10^{3}$ g/mol to about $4.0\times10^{4}$ g/mol and a shoulder starting point in a region of equal to or greater than about $1.0\times10^{5}$ g/mol; the electrophotographic toner has a weight average molecular weight of about $5.0\times10^{4}$ g/mol to about $4.0\times10^{5}$ g/mol and a Z average molecular weight of about $1.0\times10^{5}$ g/mol to about $6.0\times10^{6}$ g/mol; the electrophotographic toner has an average circularity of about 0.960 to about 0.985; and, a coefficient of variation (C.V) of the average circularity is about 1.5% to about 3.3%.

In the above preparing method, the primary binder particles may comprise at least one polymer prepared by polymerizing at least one polymerizable monomer, such as, for example, polyester, or a mixture (hybrid type) thereof. When the polymer prepared by polymerizing at least one polymerizable monomer is used as the primary binder particles, the polymer may be polymerized together with a release agent such as wax, or a release agent may be mixed with the polymer afterward.

The primary binder particles include two resin latexes having different weight average molecular weights, and more specifically, a relatively low molecular weight resin latex and a relatively high molecular weight resin latex.

The high molecular weight resin latex has a weight average molecular weight of, for example, about $1.0\times10^{5}$ g/mol to about $5.0\times10^{6}$ g/mol, about $1.5\times10^{5}$ g/mol to about $3.5\times10^{6}$ g/mol, or about $2.0\times10^{5}$ g/mol to about $3.0\times10^{6}$ g/mol. When the weight average molecular weight of the high molecular weight resin latex is within the above range, a broad fixation region is obtained and durability and gloss are improved.

A weight ratio of the low molecular weight resin latex to the high molecular weight resin latex may be, for example, about 99:1 to about 70:30, about 97:3 to about 80:20, or about 95:5 to about 85:15.

When the weight ratio is within a range of about 99:1 to about 70:30, durability and hot offset property of the toner are improved and the toner having a high gloss is obtained.

In preparing the primary binder particles, the low molecular weight resin latex, which has a molecular weight equal to or less than a critical molecular weight, may have a volume average particle diameter of about 100 nm to about 300 nm; and the high molecular weight resin latex, which has a very large molecular weight, may have a volume average particle diameter of about 100 nm to about 300 nm through emulsion polymerization or dispersion.

When the volume average particle diameters of the low molecular weight resin latex and the high molecular weight resin latex are within about 100 nm to about 300 nm, the coagulation degree can be easily adjusted during a toner preparation process, and thus a final toner having a desirable particle diameter may be provided.

The low molecular weight resin latex may have a weight average molecular weight of, for example, about $1.3\times10^4$ g/mol to about $3.0\times10^4$ g/mol, about $1.5\times10^4$ g/mol to about $2.8\times10^4$ g/mol, or about $1.7\times10^4$ g/mol to about $2.5\times10^4$ g/mol. When the weight average molecular weight of the low molecular weight resin latex is within the above ranges, strength of the toner may be improved and thus, the toner's durability and fixation may be improved.

The polymerizable monomer may be, for example, at least one monomer selected from the group consisting of styrene-based monomers such as styrene, vinyl toluene, and α-methyl styrene; acrylic acid or methacrylic acid; derivatives of (metha)acrylates such as methyl acrylate, ethyl acrylate, propyl acrylate, butyl acrylate, 2-ethylhexyl acrylate, dimethylamino ethyl acrylate, methyl methacrylate, ethyl methacrylate, propyl methacrylate, butyl methacrylate, 2-ethylhexyl methacrylate, dimethylaminoethyl methacrylate, acrylonitrile, methacrylonitrile, acrylamide, and methacryl amide; ethylenically unsaturated mono-olefins such as ethylene, propylene, and butylenes; halogenized vinyls such as vinyl chloride, vinylidene chloride, and vinyl fluoride; vinyl esters such as vinyl acetate and vinyl propionate; vinyl ethers such as vinyl methyl ether and vinyl ethyl ether; vinyl ketones such as vinyl methyl ketone and methyl isoprophenyl ketone; and nitrogen-containing vinyl compounds such as 2-vinylpyridine, 4-vinylpyridine, and N-vinyl pyrrolidone.

A polymerization initiator and a chain transfer agent may be used for efficient polymerization in a process of preparing the primary binder particles.

Examples of the polymerization initiator includes persulfate salts such as potassium persulfate and ammonium persulfate; azo compounds such as 4,4-azobis(4-cyanovaleric acid), dimethyl-2,2'-azobis(2-methyl propionate), 2,2-azobis (2-amidinopropane)dihydrochloride, 2,2-azobis-2-methyl-N-1,1-bis(hydroxymethyl)-2-hydroxyethylpropioamide, 2,2'-azobis(2,4-dimethyl valeronitrile), 2,2'-azobis isobutyronitrile, and 1,1'-azobis(1-cyclohexanecarbonitrile); and peroxides such as methyl ethyl peroxide, di-t-butylperoxide, acetyl peroxide, dicumyl peroxide, lauroyl peroxide, benzoyl peroxide, t-butylperoxy-2-ethyl-hexanoate, di-isopropyl peroxydicarbonate, and di-t-butylperoxy isophthalate. Also, an oxidization-reduction initiator in which the polymerization initiator and a reduction agent are combined may be used.

The chain transfer agent is a material to convert a type of a chain carrier in a chain reaction. A new chain may have much less activity than a previous chain. A polymerization degree of a monomer may be reduced and new chains may be initiated using the chain transfer agent. In addition, a molecular weight distribution of the toner may be adjusted using the chain transfer agent.

A content of the chain transfer agent may be, for example, in a range of about 0.1 parts by weight to about 5 parts by weight based on 100 parts by weight of one or more polymerizable monomers. For example, the content of the chain transfer agent may be in a range of about 0.2 parts by weight to about 3 parts by weight based on 100 parts by weight of one or more polymerizable monomers, or, from about 0.5 parts by weight to about 2.0 parts by weight based on 100 parts by weight of one or more polymerizable monomers. If the content of the chain transfer agent is less than about 0.1 parts by weight based on 100 parts by weight of one or more polymerizable monomers, coagulation efficiency may be reduced since a too high molecular weight may be obtained. If the content of the chain transfer agent is greater than about 5 parts by weight based on 100 parts by weight of one or more polymerizable monomers, fixation performance may be reduced since a too low molecular weight may be obtained.

Examples of the chain transfer agent include: S-containing compounds such as dodecanethiol, thioglycolic acid, thioacetic acid, and mercaptoethanol; phosphorous acid compounds such as phosphorous acid and sodium phosphite; hypophosphorous acid compounds such as hypophosphorous acid and sodium hypophosphite; and alcohols such as methyl alcohol, ethyl alcohol, isopropyl alcohol, and n-butyl alcohol. However, the chain transfer agent is not limited thereto.

The primary binder particles may further include a charge control agent. The charge control agent used herein may include a negative charge type of charge control agents or a positive charge type of charge control agents. The negative charge type of charge control agents may include an organic metal complex or a chelate compound such as an azo dye containing chromium or a mono azo metal complex; a salicylic acid compound containing a metal such as chromium, iron, and zinc; or an organic metal complex of an aromatic hydroxycarboxylic acid and an aromatic dicarboxylic acid. Moreover, any known charge control agents may be used without limitation. Examples of the positive charge type charge control agent include: a modified product such as nigrosine and a fatty acid metal salt thereof; and an onium salt including a quaternary ammonium salt such as tributylbenzylammonium 1-hydroxy-4-naphthosulfonate and tetrabutylammonium tetrafluoro borate. These materials may be used alone or in a combination of at least two. Since the charge control agent can stably support the toner on a developing roller by electrostatic force, charging may be performed stably and quickly.

The prepared primary binder particles may be mixed with a coloring agent dispersion and a release agent dispersion. The coloring agent dispersion may be prepared by homogeneously dispersing a composition including a coloring agent and an emulsifier by using an ultrasonic homogenizer, micro fluidizer, or the like. The coloring agent may be black, cyan, magenta, or yellow coloring agent.

For example, carbon black or aniline black may be used as the black coloring agent for a black toner. For color toners, at least one of yellow, magenta, and cyan coloring agents may be used.

A condensation nitrogen compound, an isoindolinone compound, an anthraquine compound, an azo metal complex, or an allyl imide compound may be used as the yellow coloring agent. In particular, C.I. pigment yellow 12, 13, 14, 17, 62, 74, 83, 93, 94, 95, 109, 110, 111, 128, 129, 147, 168, 180, or the like may be used.

A condensation nitrogen compound, an anthraquine compound, a quinacridone compound, a base dye lake compound, a naphthol compound, a benzo imidazole compound, a thioindigo compound, or a perylene compound may be used as the magenta coloring agent. In particular, C.I. pigment red 2, 3, 5, 6, 7, 23, 48:2, 48:3, 48:4, 57:1, 81:1, 122, 144, 146, 166, 169, 177, 184, 185, 202, 206, 220, 221, 254, or the like may be used.

A copper phthalocyanine compound and derivatives thereof, an anthraquine compound, or a base dye lake compound may be used as the cyan coloring agent. In particular, C.I. pigment blue 1, 7, 15, 15:1, 15:2, 15:3, 15:4, 60, 62, 66, or the like may be used.

Such coloring agents may be used alone or in a combination of at least two coloring agents, and may be selected in consideration of color, chromacity, luminance, resistance to weather, dispersion capability in toner, etc.

A content of the coloring agent may be any amount enough to color the toner. The content of the coloring agent may be in a range of, for example, about 0.5 parts by weight to about 15 parts by weight based on 100 parts by weight of the toner. For example, the content of the coloring agent may be in a range of about 1 part by weight to about 12 parts by weight based on 100 parts by weight of the toner, or of about 2 parts by weight to about 10 parts by weight based on 100 parts by weight of the toner. If the content of the coloring agent is less than about 0.5 parts by weight based on 100 parts by weight of the toner, a sufficient coloring effect may not be obtained. If the content of the coloring agent is greater than 15 parts by weight, manufacturing costs of the toner may be increased, and a sufficient frictional charge may not be obtained.

Any emulsifier that is known in the art may be used as an emulsifier in the coloring agent dispersion. For example, an anionic reactive emulsifier, a non-ionic reactive emulsifier, or a mixture thereof may be used. For example, the anionic reactive emulsifier may include HS-10 (Dai-ichi kogyo, Co., Ltd.), Dowfax 2A1 (Rhodia Inc.), etc., and the non-ionic reactive emulsifier may include RN-10 (Dai-ichi kogyo, Co., Ltd.).

The release agent dispersion used in the method for preparing the toner may comprise a release agent, water, and an emulsifier.

The release agent may allow the toner to be fused onto a final image receptor at a low fixation temperature and to exhibit superior final image durability and an anti-abrasion property. The type and content of the release agent may play an important role in determination of toner characteristics.

Examples of the release agent include polyethylene-based wax, polypropylene-based wax, silicone wax, paraffin-based wax, ester-based wax, carnauba wax, and metallocene wax. However, the release agent is not limited thereto. A melting point of the release agent may be, for example, in a range of about 50° C. to about 150° C. Release agent components physically adhere to the toner particles, but do not covalently bond with the toner particles. Thus, the toner can be fused onto the final image receptor at a low fixation temperature and have superior final image durability and an anti-abrasion property.

The content of the release agent may, for example, in a range of about 1 part by weight to about 20 parts by weight based on 100 parts by weight of the toner. For example, the content of the release agent may in a range of about 2 parts by weight to about 16 parts by weight based on 100 parts by weight of the toner, or of about 3 parts by weight to about 12 parts by weight based on 100 parts by weight of the toner. If the content of the release agent is less than about 1 part by weight based on 100 parts by weight of the toner, low-temperature fusibility may be reduced, and a fixation temperature range may become narrower. If the content of the release agent is greater than about 20 parts by weight based on 100 parts by weight of the toner, storage ability and economical efficiency may be reduced.

A wax containing an ester group may be used as the release agent. Examples of the ester group-containing wax include a mixture of an ester-based wax and a non-ester-based wax; and a non-ester-based wax containing an ester group.

Ester groups have a high affinity for the latex components of the toner. Thus, the wax may be uniformly distributed to the toner particles, thus, enhancing wax effects. In addition, a non-ester-based wax, which provides a release effect with the latex components, may inhibit excessive plasticization that occurs when the wax consists only of an ester-based wax, thus, the toner may maintain a good developing performance over a long time period.

For example, the ester-based wax may include: esters derived from a fatty acid having 15-30 carbons and a 1 to 5-hydric alcohol, such as behenic acid behenyl ester, stearic acid stearyl ester, stearic ester of pentaerythritol, and montanic acid glyceride ester. A monohydric alcohol as an alcohol component constituting the ester-based wax may have 10 to 30 carbon atoms. A polyhydric alcohol as an alcohol component constituting the ester-based wax may have 3 to 10 carbon atoms.

The non-ester-based wax may include a polyethylene-based wax and a paraffin-based wax.

An example of the ester group-containing wax is a mixture of a paraffin-based wax and an ester-based wax; or an ester group-containing paraffin-based wax. Particularly, model names P-280, P-318, and P-319 (products of Chongqing Oil Purifier Manufacture Co., Ltd) may be used as the ester group-containing wax.

When the release agent includes a mixture of a paraffin-based wax and an ester-based wax, a content of the ester-based wax in the release agent may be, for example, in a range of about 1% by weight to about 35% by weight based on a total weight of the release agent. For example, the content of the ester-based wax may be in a range of about 3% by weight to about 33% by weight based on the total weight of the release agent, or of about 5% by weight to about 30% by weight based on the total weight of the release agent.

When the content of the ester-based wax is equal to or greater than about 1% by weight based on the total weight of the release agent, compatibility with a latex may be sufficiently maintained. When the content of the ester-based wax is equal to or less than 35% by weight based on the total weight of the release agent, plasticity of the toner may be appropriate and thus the toner may maintain a good developing performance over a long term period, anti-offset is improved during high temperature fixation, and a high gloss is obtained.

Any emulsifier that is known in the art may be used as an emulsifier used in the release agent dispersion, similar to the emulsifier used in the coloring agent dispersion. For example, an anionic reactive emulsifier, a non-ionic reactive emulsifier, or a mixture thereof may be used. For example, the anionic reactive emulsifier may include HS-10 (Dai-ichi kogyo, Co., Ltd.), Dowfax 2A1 (Rhodia Inc.), etc., and the non-ionic reactive emulsifier may include RN-10 (Dai-ichi kogyo, Co., Ltd.).

An average molecular weight, $T_g$, and rheological properties of the primary binder particles formed in a core of the toner prepared according to the method described above may be adjusted to efficiently fuse the toner particles at a low temperature.

The prepared primary binder particles, the coloring agent dispersion, and the release agent dispersion are mixed, and then a coagulant is added to the mixture to prepare a coagulated toner. More particularly, when the primary binder particles, the coloring agent dispersion, and the release agent dispersion are mixed, the coagulant is added to the mixture having a pH of about 0.1 to about 2.0 to form a primary coagulated toner having an average particle size equal to or less than about 2.5 μm as a core. Then, secondary binder particles are added to the resultant, and the pH thereof is adjusted to about 6 to about 8. After the particle size is maintained constant for a certain period of time, the resultant is heated to a temperature in a range of about 90° C. to about 98° C., and the pH is adjusted to about 5 to about 6, and then, the unifying process is performed to obtain toner particles.

The coagulant may be, for example, NaCl, $MgCl_2$, $MgCl_2.8H_2O$, ferrous sulfate, ferric sulfate, ferric chloride, hydrated lime, calcium carbonate, or Si and Fe containing metallic salts but is not limited thereto.

A content of the coagulant may be, for example, about 0.1 parts by weight to about 10 parts by weight based on 100 parts by weight of a total weight of the primary binder particles, about 0.5 parts by weight to about 8 parts by weight based on 100 parts by weight of the total weight of the primary binder particles, or, about 1 parts by weight to about 6 parts by weight based on 100 parts by weigh of the total weight of the primary binder particles. When the content of the coagulant is less than about 0.1 parts by weight based on 100 parts by weight of the total weight of the primary binder particles, coagulation efficiency may be deteriorated. When the content of the coagulant is greater than about 10 parts by weight based on 100 parts by weight of the total weight of the primary binder particles, charging of the toner may be deteriorated and a particle size distribution may be worsened.

According to an embodiment of the present disclosure, a metallic salt containing Si and Fe may be used as a coagulant during a toner manufacturing process, and a Si and Fe content in the prepared toner may be, for example, about 3 ppm to about 30,000 ppm, about 30 ppm to about 25,000 ppm, or, about 300 ppm to about 20,000 ppm. If the Si and Fe content is less than about 3 ppm, it may be difficult to obtain a desired effect from adding the metallic salt, and if the Si and Fe content is more than about 30,000 ppm, charging of the toner may be deteriorated and contamination inside a printer may occur.

The Si and Fe-containing metallic salt includes, for example, iron (Fe)-polysilicate. Specifically, the Si and Fe-containing metallic salt may be added to obtain an increased ionic strength. The increased ionic strength and the collisions between particles during the toner preparation method according to the present disclosure, may allow the size of the primary coagulated toner to increase. An example of the Si and Fe-containing metallic salt is polysilica iron. Particularly, model Nos. PSI-025, PSI-050, PSI-085, PSI-100, PSI-200, and PSI-300 (products of SOODO Mechanical Co.), which are sold and available in markets, may be used. Properties and compositions of PSI-025, PSI-050, PSI-085, PSI-100, PSI-200 and PSI-300 are listed in Table 1 below.

TABLE 1

| Product Name | | PSI-025 | PSI-050 | PSI-085 | PSI-100 | PSI-200 | PSI-300 |
|---|---|---|---|---|---|---|---|
| mole ratio (Si/Fe) | | 0.25 | 0.5 | 0.85 | 1 | 2 | 3 |
| Main component concentration | Fe(wt %) | 5.0 | 3.5 | 2.5 | 2.0 | 1.0 | 0.7 |
| | $SiO_2$(wt %) | 1.4 | 1.9 | 2.0 | | 2.2 | |
| pH (1 w/v %) | | 2-3 | | | | | |
| Specific gravity (20° C.) | | 1.14 | 1.13 | 1.09 | 1.08 | 1.06 | 1.04 |
| Viscosity (mPa · S) | | 2.0 or higher | | | | | |
| Average molecular weight (Dalton) | | 500,000 | | | | | |
| Appearance | | Yellowish brown transparent liquid | | | | | |

When the Si and Fe-containing metallic salt is used as the coagulant in the toner preparation method, a particle shape of the toner particles may be more easily controlled, and a further smaller particle size of the toner particles may be obtained.

The coagulant solution may be prepared, for example, by adding an aqueous solution of an acid, such as nitric acid, to the above coagulant. For example, the coagulant solution may have a pH of equal to or less than about 2.0, of about 0.1 to about 2.0, of about 0.3 to about 1.8, or, of about 0.5 to about 1.6. When the coagulant solution has a pH less than about 0.1, since the coagulant solution is a strong acid, the coagulant solution is difficult to handle. When the coagulant solution has a pH more than about 2.0, iron in the coagulant may not control generation of a smell of a sulfur containing compound, such as a chain transfer agent, which has been used during a latex preparing process, and coagulation efficiency is deteriorated.

The secondary binder particles may be prepared by polymerizing at least one polymerizable monomer, such as in the manner described above, and this polymerization process may provide particles having a size of equal to or less than about 1 μm, or of about 100 nm to about 300 nm through emulsion polymerization dispersion. The secondary binder particles may include a release agent that may be included in the secondary binder particles during the polymerization process.

In more detail, the step for preparing the toner particles includes: a) coagulating the core layer particles and the shell layer particles under a temperature range in which a shear storage modulus G' of the core layer particles and the shell layer particles is about $1.0\times10^8$ Pa to about $1.0\times10^9$ Pa; b) stopping the coagulating when an average diameter of particles formed in a) becomes about 70% to about 100% of an average diameter of the toner particles; and c) fusing and unifying particles prepared in b) under a temperature range in which a shear storage modulus G' of particles prepared in b) is about $1.0\times10^4$ Pa to about $1.0\times10^9$ Pa.

The coagulating of the core layer particles and the shell layer particles is a process where physical coagulation occurs. By performing the process under a temperature range in which the shear storage modulus G' of the core layer particles and the shell layer particles is about $1.0\times10^8$ Pa to about $1.0\times10^9$ Pa, the core layer particles and the shell layer particles may be prevented from being prematurely unified, and thus a particle size distribution can be more easily controlled.

The step of fusing and unifying the particles prepared in b) may be accomplished by heating the particles under a temperature range in which the shear storage modulus G' of the particles obtained in b) is about $1.0\times10^4$ Pa to about $1.0\times10^9$ Pa, i.e., a temperature range that is higher than a melting point of the particles obtained in b) by about 10° C. to about 30° C.

That is, after the secondary binder particles serving as shell layers for the core layer particles are added, the reaction system is adjusted to have a pH of about 6 to about 9. Then, when the toner particle size is not any more increased for a predetermined time, the temperature is raised to about 90° C. to about 98° C., lowering the pH to about 5 to about 7, and unifying the toner particles.

A tertiary latex prepared by polymerizing one or more polymerizable monomers may be coated on the secondary coagulated toner.

By forming a shell layer with the secondary latex or with the secondary latex and the tertiary latex, durability may be improved, and storability limitations of the toner during shipping and handling may be overcome. Here, a polymerization inhibitor may be added in order to prevent new latex particles from being formed, or the reaction may be performed using a starved-feeding process to facilitate coating of the monomer mixture on the toner.

The prepared toner particles go through filtering, separating, and drying processes. An external additive is added in the dried toner particles and then a charging charge amount thereof is adjusted to obtain a final dry toner.

The external additive may include silicon containing particles and titanium containing particles.

The silicon containing particles include a large diameter silicon containing particles having a volume average particle diameter of about 30 nm to about 100 nm and a small diameter silicon containing particles having a volume average particle diameter of about 5 nm to about 20 nm, but the silicon containing particles are not limited thereto.

The small diameter silicon containing particles and the large diameter silicon containing particles are added to provide negative charging and fluidity. The silicon containing particles may be prepared from halides of silicon through a dry process. The silicon containing particles may be precipitated from a liquid containing a silicon compound through a wet process.

For example, the large diameter silicon containing particles may have a volume average particle diameter of about 30 nm to about 100 nm. The large diameter silicon containing particles may improve anti-adhesion between toner particles or between a toner particle and a surface. For example, the small diameter silicon containing particles may have a volume average particle diameter of about 5 nm to about 20 nm. The small diameter silicon containing particles may impart an improved fluidity to the toner.

A content of the large diameter silicon containing particles may be, for example, about 0.1 parts by weight to about 3.5 parts by weight, about 0.5 parts by weight to about 3.0 parts by weight, or about 1.0 part by weight to about 2.5 parts by weight, based on 100 parts by weight of the bare toner particles which are not yet added with external additives. When the content is within a range of about 0.1 parts by weight to about 3.5 parts by weight based on 100 parts by weight of the bare toner particles, fixation deterioration, over charging, contamination, and filming may be prevented.

A content of the small diameter silicon containing particles may be, for example, about 0.1 parts by weight to about 2.0 parts by weight, about 0.3 parts by weight to about 1.5 parts by weight, or about 0.5 parts by weight to about 1.0 part by weight, based on 100 parts by weight of the bare toner particles. When the content of the small diameter silicon containing particles is within a range of about 0.1 parts by weight to about 2.0 parts by weight based on 100 parts by weight of the bare toner particles, fixation may be improved and over charging and defective cleaning may be prevented.

The titanium containing particles may include, for example, titanium dioxide, but is not limited thereto.

The titanium containing particles may improve charging amount, and may provide excellent environmental characteristics. For example, the titanium containing particles may prevent a toner charge up issue in low temperature and low humidity environments, and may prevent a toner charge down issue in high temperature and high humidity environments. Additionally, the titanium containing particles may improve fluidity of the toner, and may allow high transfer efficacy to be maintained when a large amount of printing has been performed for a long term. A volume average diameter of the titanium containing particle may be, for example, about 10 nm to about 20 nm. A content of the titanium containing particles may be, for example, about 0.1 parts by weight to about 2.0 parts by weight, about 0.3 parts by weight to about 1.5 parts by weight, or, about 0.5 parts by weight to about 1.0 part by weight, based on 100 parts by weight of the bare toner particles. When the content of the titanium containing particles is within a range of about 0.1 parts by weight to about 2.0 parts by weight based on 100 parts by weight of the bare toner particles, charging maintainability according to an environment may be improved and image contamination and charging amount deterioration may be resolved.

The present disclosure provides a method of forming images including attaching an electrophotographic toner to a surface of a photoconductor on which an electrostatic latent image is formed to develop the image, and transferring the developed image to a transfer medium. The electrophotographic toner includes a binder with two resins having different weight average molecular weights, a coloring agent, and a release agent and has a molecular weight distribution curve including a main peak in a region of about $8.0\times10^3$ g/mol to about $4.0\times10^4$ g/mol and a shoulder starting point in a region equal to or greater than about $1.0\times10^6$ g/mol. Also, the electrophotographic toner has a weight average molecular weight of about $5.0\times10^4$ g/mol to about $4.0\times10^6$ g/mol and a Z average molecular weight of about $1.0\times10^6$ g/mol to about $6.0\times10^6$ g/mol. The electrophotographic toner has an average circularity of about 0.960 to about 0.985. A coefficient of variation (C.V) of the average circularity is about 1.5% to about 3.3%. The electrophotographic toner has a BET surface area of about 1.5 $m^2/g$ to about 3.5 $m^2/g$.

The electrophotographic image forming process may typically include a series of processes for forming images on a receptor, such as, for example, charging, light exposing, developing, transferring, fixation, cleaning, and erasing.

In the charging process, a surface of a photoconductor is charged with negative or positive charges, as desired, by a corona or a charge roller. In the light exposing process, an optical system, conventionally a laser scanner or an array of diodes, selectively discharges the charged surface of the photoconductor in an image-wise manner corresponding to a final image formed on a final image receptor to form a latent image. The optical system uses electromagnetic radiation, also referred to as light, which may be infrared light, visible light, or ultra-violet light.

In the developing process, suitably charged toner particles are brought into contact with the latent image of the photoconductor. Usually, an electrically-biased developing unit having a polarity identical to that of the toner particles are used in the developing process. The toner particles move to the photoconductor and are selectively attached to the latent image of the photoconductor by electrostatic force, and thus a toner image is formed on the photoconductor.

In the transferring process, the toner image is transferred to the final image receptor from the photoconductor, and sometimes, an intermediate transferring element is used to facilitate transferring the toner image from the photoconductor to the final image receptor.

In the fixing process, the toner image of the final image receptor is heated and the toner particles thereof are softened or melted, thereby fixing the toner image to the final image receptor. Another way of fixing the toner image to the final image receptor is to fuse the toner particles on the final image receptor under a high pressure with or without application of heat.

In the cleaning process, residual toner remaining on the photoconductor is removed.

Finally, in the erasing process, charges of the photoconductor are exposed to light of a predetermined wavelength band and are reduced to be substantially uniform and of low value, and thus a residue latent image is removed and the photoconductor is prepared for a next image forming cycle.

An embodiment provides a toner supplying apparatus including a toner tank in which an electrophotographic toner is stored; a supplying part projecting inside the toner tank to supply the stored toner to the outside; and a toner agitating member rotatably disposed inside the toner tank to agitate the toner in almost an entire inner space of the toner tank including a top surface of the supplying part. The electrophotographic toner according to the present general inventive concept includes a binder with two resins having different weight average molecular weights, a coloring agent, and a release agent and has a molecular weight distribution curve including a main peak in a region of about $8.0\times10^3$ g/mol to about $4.0\times10^4$ g/mol and a shoulder starting point in a region equal to or greater than about $1.0\times10^5$ g/mol. Also, the electrophotographic toner has a weight average molecular weight of about $5.0\times10^4$ g/mol to about $4.0\times10^5$ g/mol and a Z average molecular weight of about $1.0\times10^5$ g/mol to about $6.0\times10^6$ g/mol. The electrophotographic toner has an average circularity of about 0.960 to about 0.985. A coefficient of variation (C.V) of the average circularity is about 1.5% to about 3.3%. The electrophotographic toner has a BET surface area of about 1.5 $m^2/g$ to about 3.5 $m^2/g$.

FIG. 1 is a view of a toner supplying apparatus according to an embodiment of the present general inventive concept. The toner supplying apparatus will be described below.

The toner supplying apparatus 100 includes a toner tank 101, a supplying part 103, a toner-conveying member 105, and a toner-agitating member 110.

The toner tank 101 stores a predetermined amount of a toner and may be formed in a substantially hollow cylindrical shape.

The supplying part 103 is disposed at a bottom of an inside of the toner tank 101 and discharges the stored toner from the inside of the toner tank 101 to an outside of the toner tank 101. For example, the supplying part 103 may project from the bottom of the toner tank 101 to the inside of the toner tank 101 in a pillar shape with a semi-circular section. A toner outlet (not shown) is formed in the outer surface of the supplying part 103 to discharge the toner through the toner outlet.

The toner-conveying member 105 is disposed at a side of the supplying part 103 at the bottom of the inside of the toner tank 101. The toner-conveying member 105 may be formed in, for example, a coil spring shape. An end of the toner-conveying member 105 extends in an inside the supplying part 103 such that the toner in the toner tank 101 is conveyed to the inside of the supplying part 103 when the toner conveying member 150 rotates. The toner conveyed by the toner-conveying member 105 is discharged to the outside through the toner outlet.

The toner-agitating member 110 is rotatably disposed inside the toner tank 101 and forces the toner in the toner tank 101 to move in a radial direction. For example, when the toner-agitating member 110 rotates at a middle of the toner tank 101, the toner in the toner tank 101 is agitated to prevent the toner from solidifying. As a result, the toner moves down to the bottom of the toner tank 101 due to its own weight. The toner-agitating member 110 includes a rotation shaft 112 and a toner agitating film 120. The rotation shaft 112 is rotatably disposed at the middle of the toner tank 101 and has a driving gear (not shown) coaxially coupled with an end of the rotation shaft 112 projecting from a side of the toner tank 101. Therefore, rotation of the driving gear causes the rotation shaft 112 to rotate. Also, the rotation shaft 112 may have a wing plate 114 to help fix the toner agitating film 120 to the rotation shaft 112. The wing plate 114 may be centered on the rotation shaft 112 and have a symmetric shape. The toner agitating film 120 has a width corresponding to an inner length of the toner tank 101. Furthermore, the toner agitating film 120 may be elastically deformable. For example, the toner agitating film 120 may bend toward or away from the supplying part 103, which is a projection inside the toner tank 101.

Portions of the toner agitating film 120 toward the rotation shaft 112 may be cut off from the toner agitating film 120 to form a primary agitating part 121 and a secondary agitating part 122.

The present general inventive concept also provides an image forming apparatus including a photoconductor; an image forming unit for forming a latent image on a surface of the photoconductor; a unit receiving a electrophotographic toner; a toner supplying unit for supplying the toner to the surface of the photoconductor to develop the latent image formed on the surface of the photoconductor so as to develop a toner image; and a toner transfer unit for transferring the toner image from the surface of the photoconductor to a transferring medium. The electrophotographic toner has a molecular weight distribution curve including a main peak in a region of about $8.0\times10^3$ g/mol to about $4.0\times10^4$ g/mol and a shoulder starting point in a region equal to or greater than about $1.0\times10^5$ g/mol. Also, the electrophotographic toner has a weight average molecular weight of about $5.0\times10^4$ g/mol to about $4.0\times10^5$ g/mol and a Z average molecular weight of about $1.0\times10^5$ g/mol to about $6.0\times10^6$ g/mol. The electrophotographic toner has an average circularity of about 0.960 to about 0.985. A coefficient of variation (C.V) of the average circularity is about 1.5% to about 3.3%. The electrophotographic toner has a BET surface area of about 1.5 $m^2/g$ to about 3.5 $m^2/g$.

Figure 2:
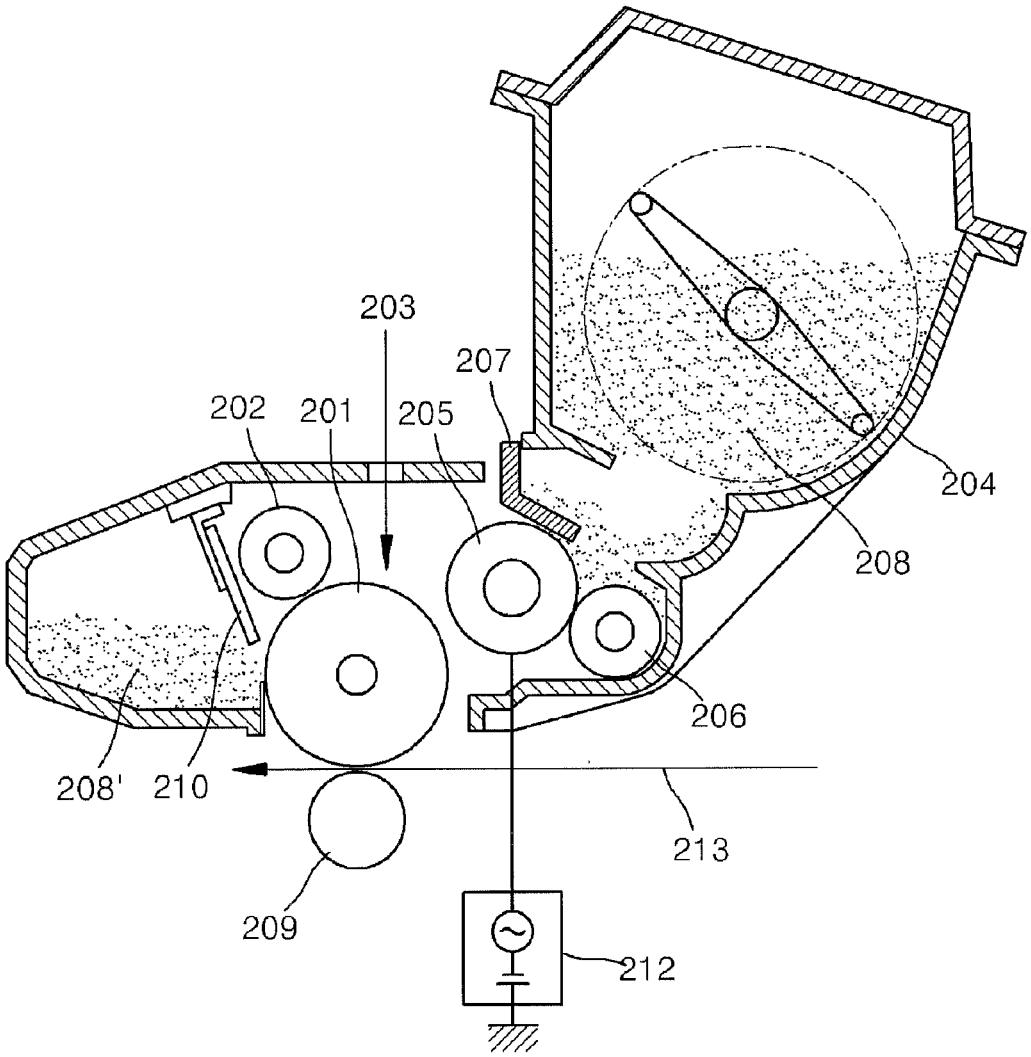
FIG. 2 schematically illustrates an image forming apparatus containing a toner according to an embodiment of the present disclosure.

FIG. 2 is a view of a non-contact development type imaging apparatus including a toner according to an embodiment of the present general inventive concept. And its operating principle will be described.

A developer 208 such as a nonmagnetic one-component developer is supplied from a developing device 204 to a developing roller 205 through a supply roller 206 formed of an elastic material, such as polyurethane foam or sponge. The developer 208 supplied to the developing roller 205 reaches a contact portion between a developer controlling blade 207 and the developing roller 205 due to rotation of the developing roller 205. The developer controlling blade 207 may be formed of an elastic material, such as metal or rubber. When the developer 208 passes through the contact portion between the developer controlling blade 207 and the developing roller 205, the developer 208 is controlled and formed into a thin layer that has a uniform thickness and is sufficiently charged. The developer 208 formed into a thin layer is transferred to a development region of a photoconductor 201 as a latent image receptor, on which a latent image is developed by the developing roller 205. At this time, the latent image is formed by scanning light 203 to the photoconductor 201.

The developing roller 205 is separated from the photoconductor 201 by a predetermined distance and faces the photoconductor 201. The developing roller 205 rotates in a counterclockwise direction, and the photoconductor 201 rotates n clockwise direction.

The developer 208 transferred to the development region of the photoconductor 201 develops the latent image formed on the photoconductor 201 by an electric force generated by a potential difference between a direct current (DC) biased alternating current (AC) voltage 212 applied to the developing roller 205 and a latent potential of the photoconductor 201 charged by a charging unit 202 so as to form a toner image.

The developer 208 transferred to the photoconductor 201 reaches a transfer unit 209 due to the rotation direction of the photoconductor 201. The developer 208 transferred to the photoconductor 201 is transferred to a print medium 213 to form an image by the transfer unit 209 having a roller shape and to which a high voltage having a polarity opposite to that of the developer 208 is applied, or by corona discharging when the print medium 213 passes between the photoconductor 201 and the transfer unit 209.

The image transferred to the print medium 213 passes through a high temperature and high pressure fixing device (not shown) and thus the developer 208 is fused to the print medium 213 to form the image. Meanwhile, a non-developed, residual developer 208' on the developing roller 205 is collected by the supply roller 206 in contact with the developing roller 205, and the non-developed, residual developer 208' on the photoconductor 201 is collected by a cleaning blade 210. The processes described above are repeated.

The present general inventive concept will be described with an embodiment below but is not limited thereto.

Preparation Example 1

Synthesis of Low Molecular Weight Resin Latex (L-LTX)

A polymerizable monomer mixture (825 g of styrene and 175 g of n-butyl acrylate), 30 g of beta-carboxyethyl acrylate (Sipomer, Rhodia), 17 g of 1-dodecanethiol as a chain transfer agent (CTA), and 418 g of 2 wt % aqueous solution of sodium dodecyl sulphate (Aldrich) as an emulsifier were stirred in a 3 L beaker to prepare a polymerizable monomer emulsion. 16 g of ammonium persulfate (APS) as an initiator and 696 g of 0.4 wt % aqueous solution of sodium dodecyl sulphate (Aldrich) as an emulsifier were added and agitated in a 3 L double jacketed reactor heated to 75° C., and then the prepared polymerizable monomer emulsion was slowly dripped into the 3 L double jacketed reactor for 2 hours. The mixture was reacted at a reaction temperature of 75° C. for 8 hours to produce resin latex particles. A size of the prepared resin latex particle measured through a light scattering method (Horiba 910) was 180 nm to 250 nm, and a solid fraction of the prepared resin latex particles measured through a dry reducing method was 42 wt %. In a molecular weight measurement using a gel permeation chromatography (GPC) method using tetrahydrofuran (THF) solvent, the weight average molecular weight (Mw) was 25,000 g/mol. The glass transition temperature measured by scanning twice at a heating rate of 10° C./min using a DSC (PerkinElmer) was 62° C.

Preparation Example 2

Synthesis of High Molecular Weight Resin Latex (H-LTX)

A polymerizable monomer mixture (685 g of styrene and 315 g of n-butyl acrylate), 30 g of beta-carboxyethyl acrylate (Sipomer, Rhodia), and 418 g of 2 wt % aqueous solution of sodium dodecyl sulphate (Aldrich) as an emulsifier were added to a 3 L beaker and the contents in the 3 L beaker were agitated to prepare a polymerizable monomer emulsion. 5 g of ammonium persulfate (APS) as an initiator and 696 g of 0.4 wt % aqueous solution of sodium dodecyl sulphate (Aldrich) as an emulsifier were added and agitated in a 3 L double jacketed reactor heated to 60° C., and then the prepared polymerizable monomer emulsion was slowly dripped into the 3 L double jacketed reactor for 3 hours. The mixture was reacted at a reaction temperature of 75° C. for 8 hours to produce resin latex particles. A size of the prepared resin latex particle measured through a light scattering method (Horiba 910) was 180 nm to 250 nm, and a solid fraction of the latex particles measured through a dry reducing method was 42 wt %. In a molecular weight measurement using a gel permeation chromatography (GPC) method using tetrahydrofuran (THF) solvent, the weight average molecular weight (Mw) was 250,000 g/mol. The glass transition temperature measured by scanning twice at a heating rate of about 10° C./min using a DSC (PerkinElmer) was 53° C.

Preparation Example 3

Preparation of Coloring Agent Dispersion 10 g of sodium dodecyl sulphate (Aldrich) as an anionic reactive emulsifier, 60 g of a cyan coloring agent, and 400 g of glass beads having a diameter of 0.8 mm to 1 mm were added to a milling bath and milled at room temperature to prepare a dispersion. As an emulsifying mixer, an ultrasonic homogenizer (Sonic and Materials VCX750) was used. A coloring agent particle diameter in the dispersion was measured using a light scattering method (Horiba 910) was 180 nm to 200 nm. A solid fraction of the prepared coloring agent dispersion was 16.8 wt %.

<Preparation of Electrophotographic Toner>

Example 1

Preparation of Toner 2,600 g of deionized water, 1,193 g of a mixture of the resin latexes synthesized in the preparation example 1 and the preparation example 2 (a mixture including 95 wt % of L-LTX and 5 wt % of H-LTX) for forming primary binder particles, 250 g of the cyan coloring agent dispersion obtained in the preparation example 3, and 237 g of a release agent dispersion P-419 with a solid fraction of 30.5 wt % (Chongqing Oil Purifier Manufacture Co., Ltd) (20 wt % to 30 wt % of paraffin wax, 10 wt % to 20 wt % of synthetic ester wax, and 60 wt % to 70 wt % of water; viscosity (at 25° C.) of 18 mPa·s; and melting point of 89° C. to 91° C.) were added in a 7 L reactor to prepare a mixture. 372 g of nitric acid aqueous solution (0.3 mol) and 186 g of PSI-100 (products of SOODO Mechanical Co.) as an coagulant were added to the mixture and the mixture was agitated for 6 min at 11,000 rpm using a homogenizer to obtain core layer particles having a volume average diameter of 1.5 μm to 2.5 μm. The mixture was put into a 7 L double jacketed reactor and heated from room temperature to 55° C. (equal to or greater than latex Tg−5° C.) at a rate of 0.5° C. per minute. When the volume average diameter of the core layer particles reached 6.3 μm, 442 g of a mixture of the resin latexes synthesized in the preparation example 1 and the preparation example 2 (a mixture of 90 wt % L-LTX and 10 wt % of H-LTX) was slowly added to the 7 L double jacketed reactor for 20 minutes. Next, when the volume average diameter reached 6.8 μm, NaOH (1 mol aqueous solution) was added to adjust a pH of the mixture to 7. When the volume average diameter was not any more increased for 10 minutes, the temperature was raised up to 94° C. (0.5° C./min). Without adjusting the pH after the temperature reached about 94° C., a secondary coagulant toner having a potato shape was obtained through unification for 5 hours. Next, the coagulating-reaction mixture was cooled down below Tg of the latexes at a rate of 2.0° C./min using cooling water at 25° C., and then was heated up to 60° C., and then was adjusted to pH 9 using a NaOH aqueous solution. Then, after several cleaning processes using deionized water were performed, toner particles were separated and dried.

The dried toner particles were subjected to an external adding process by adding 0.5 parts by weight of NX-90 (Nippon Aerosil), 1.0 parts by weight of RX-200 (Nippon Aerosil), and 0.5 parts by weight of SW-100 (Titan Kogyo) to 100 parts by weight of the dried toner particles, and agitating the mixture in a mixer (KM-LS2K, Dae Wha Tech) at 8,000 rpm for 4 minutes. The circularity of the prepared final toner was 0.963.

Example 2

A toner was prepared using the same method as described in the example 1, except that, after the temperature reached 94° C., the pH was adjusted to 6.0 using a 0.3 N nitric acid aqueous solution. The circularity of the prepared toner was 0.973.

Example 3

A toner was prepared using the same method as described in the example 1, except that, after the temperature reached about 96° C., the pH was adjusted to 5.6. The circularity of the prepared toner was 0.982.

Comparison Example 1

A toner was prepared using the same method as described in the example 2, except that, after the cooling-down, the coagulating-reaction mixture was heated to 60° C., and was adjusted to pH 10 to 11. The circularity of the prepared toner was 0.968.

Comparison Example 2

A toner was prepared using the same method as described in the example 1, except that the unifying time was less than one hour. The circularity of the prepared toner was 0.944.

Comparison Example 3

A toner was prepared using the same method as described in the example 1, except that: after the mixture was added to the 7 L double jacketed reactor, the mixture was heated from room temperature to 56° C. (a temperature about 1° C. higher than that in the example 1) by 0.5° C. per min; and, after the temperature reached 94° C., the pH was adjusted to 6.0 using nitric acid (0.3 N). The circularity of the prepared toner was about 0.963.

Evaluation Method of Toner

<Weight Average Molecular Weight and Z Average Molecular Weight Measurement Method>

A weight average molecular weight (Mw) and Z average molecular weight (Mz) of a toner were measured by a gel permeation chromatography (GPC) (Alliance Company). An RI detector Waters 2414 was used as a detector and three columns of Strygel HR 5, 4, 2 were used. Tetrahydrofuran was used as an carrier solvent and its flow rate was 1 ml/min. Also, a concentration of a measurement sample was 1 wt % and an injection volume was 50 μl. 10 types of standard samples at a concentration of 0.5 wt % were used for calibration. Standard sample solutions were prepared as follows.

<standard sample 1 solutions> molecular weights: 1,200/7,210/196,000/257,000/1,320,000, THF mixing ratio by volume=1:1:1:1:0.5:0.5.

<standard sample 2 solution> molecular weights: 3,070/49,200/113,000/778,000/3,150,000, THF mixing ratio by volume=1:1:1:1:0.5:0.5.

<Measurement of Toner Circularity>

A sample was prepared by adding 0.02 g of a toner into 18 ml of distilled water and dispersing the toner in the distilled water using 0.3% of Contaminon as a surfactant. FPIA-3000 equipment of SYSMEX Corporation was used (where 30,000 particles were counted). Each particle was extracted and quantified through a digital imaging process. A circularity and a coefficient of variation were calculated based on the following equation.

$$\text{Circularity}=2\times(\pi\times\text{area})^{0.5}/\text{circumference} \quad \text{[Circularity equation]}$$

A circularity is a value in a range of 0 to 1 and as a circularity of an object approaches 1, the object becomes more circular.

$$\text{Coefficient of variation}=(S1/K)\times100 \quad \text{[Coefficient of variation equation]}$$

where S1 represents a standard deviation of circularities of 100 toner particles and K represents an average value of the circularities.

<BET Surface Area Measurement of Toner>

A BET surface measurement of a toner was measured using a BET surface area measuring device (Macsorb HM-1208) (manufacturer: MOUNTECH).

BET surface areas of a toner and an external additive were obtained according to a BET method, in which a BET surface area of a particle was calculated by measuring an amount of gas adsorbed physically to a particle surface when the particle was at a low temperature under static flow.

Before measurement of the BET surface area, 1 g of a sample was filled in a sample tube and a pretreatment was performed (using $N_2$ for 30 min at 30° C.). The pretreated sample was separated from a pretreatment apparatus and was mounted on an auto sampler. $N_2$($N_2$:He=30:70) was adsorbed to the sample. And, when saturation was reached, a desorption process and a calibration (using 1 cc of $N_2$ Gas) process were performed. Then, a value of BET surface area was calculated.

<Volume Average Particle Diameter, Particle Diameter Distribution Measurement of Toner>

Coulter Counter Multisizer III instrument (manufacturer: Beckman Coulter company) was used for the measurement. 18 ml of distilled water, a surfactant (0.3% of contaminon), and 0.02 g of toner powder were added in a 20 ml glass vial and dispersed for 30 min using a sonicator, and then a diameter was measured. Among the cumulative distribution data, a value of D50v is defined as a volume average particle diameter. And a diameter of 84% accumulation is defined as a volume average particle diameter D84v or as a number average diameter D84p.

A volume average particle size distribution index GSDv and a number average particle distribution index GSDp may be calculated using the following relational expressions: GSDv is defined as $(D84v/D16v)^{0.5}$; and GSDp is defined as $(D84p/D16p)^{0.5}$.

<Toner Charging Characteristic Evaluation>

18.4 g of carriers (i.e. spherical magnets having a size of 35 μm) and 1.6 g of toner were added in an 80 ml glass container and then agitated using a tubular mixer. Then, a charging amount of the toner was measured using a field separation method.

Charging stability of a toner according to agitation time under room temperature and normal humidity, and a ratio of a charging amount at a high temperature and high humidity to a charging amount at a low temperature and low humidity were used as criteria of evaluation.

Room temperature and normal humidity: 23° C., RH 55%

High temperature and high humidity: 30° C., RH 82%

Low temperature and low humidity: 10° C., RH 10%

♦ Charging stability

According to a value of [a charging value after 1 min agitation/a charging value after 10 min agitation]*100(%), a charging stability was evaluated as follows.

○: 80-100

Δ: equal to or more than 60, and less than 80×: less than 60

♦ Charging environmental ratio (H/L)

According to a ratio of a charging value after agitation for 10 min in an HH environment (30° C., RH 82%)/a charging value after agitation for 10 min in an LL environment (10° C., RH 10%), a charging environment ratio was graded as follows.

◎: 0.99~0.70

○: 0.69~0.50 x: less than 0.50, or, 1.00 or more

<Image Durability Evaluation>

1%-coverage pattern was printed continuously using a printer (manufacturer: Samsung electronics, product name: CRP-325 SET) and then the number of cycles in which an image concentration of a solid pattern is maintained was measured. The evaluation criteria are as follows.

◎: 5,000 or more sheets in which an image concentration is maintained

○: 3,000 or more and less than 5,000 sheets in which an image concentration is maintained Δ: 1,000 or more and less than 3,000 sheets in which an image concentration is maintained x: less than 1,000 sheets in which an image concentration is maintained <Fluidity and Thermal-Fluidity Evaluation>

2 g of toner was left in a high temperature and high humidity environment (50° C., RH 80%, 15 hr; i.e. thermal-fluidity evaluation condition) and in a room temperature and normal humidity environment (23° C., RH 55%, 2 hr; i.e. fluidity evaluation condition). Then, a fluidity of toner according to environmental conditions was measured using 38, 45, and 53 μm sieves by a powder test model PT-S level 3 and 40-sec condition.

Fluidity Criteria

○: 0~7

Δ: more than 7, and, equal to or less than 10 x: more than 10

Thermal-Fluidity Criteria

○: 0~8

Δ: more than 8, and, equal to or less than 13 x: more than 13

<Transfer Efficiency Evaluation>

A transfer efficiency was calculated using a ratio of [a toner (g) on an image transfer belt (ITB)]/[a toner (g) on an organic photo conductor (OPC)] with respect to a predetermined region in a Samsung electronics CRP-325 set.

◎: 0.9~1.0

○: equal to or more than 0.7, and, less than 0.9 x: less than 0.7

TABLE 2

| | Main peak position (Mp, g/mol) | Shoulder starting point (g/mol) | Toner weight average molecular weight (Mw, g/mol) | Toner z average molecular weight (Mz, g/mol) | Average circularity | Coefficient of variation of average circularity (C.V, %) | BET surface area ($m^2/g$) |
|---|---|---|---|---|---|---|---|
| Example 1 | 27,758 | 61,830,955 | 74,058 | 2,420,421 | 0.963 | 2.54 | 3.15 |
| Example 2 | 21,592 | 53,256,614 | 66,571 | 2,204,319 | 0.973 | 2.16 | 2.68 |
| Example 3 | 22,841 | 57,986,657 | 70,548 | 3,586,401 | 0.982 | 1.75 | 1.89 |
| Comparative Example 1 | 22,407 | 64,545,913 | 74,263 | 3,954,195 | 0.968 | 3.10 | 3.62 |
| Comparative Example 2 | 22,739 | 48,940,046 | 69,031 | 2,216,397 | 0.944 | 3.53 | 3.7 |
| Comparative Example 3 | 23,508 | 67,269,510 | 79,957 | 2,305,853 | 0.963 | 3.94 | 3.22 |

TABLE 3

| | Volume average particle diameter (μm) | GSDp | GSDv | Charging stability | Charging environmental ratio (H/L) | Image durability | Fluidity | Thermal fluidity | Transfer efficiency |
|---|---|---|---|---|---|---|---|---|---|
| Example 1 | 6.95 | 1.263 | 1.228 | ○ | ○ | ○ | ○ | ○ | ○ |
| Example 2 | 6.93 | 1.258 | 1.225 | ○ | ○ | ◎ | ○ | ○ | ○ |
| Example 3 | 6.74 | 1.264 | 1.229 | ○ | ◎ | ○ | ○ | ○ | ◎ |
| Comparative Example 1 | 6.77 | 1.253 | 1.225 | Δ | X | Δ | Δ | Δ | ○ |

TABLE 3-continued

| | Volume average particle diameter (μm) | GSDp | GSDv | Charging stability | Charging environmental ratio (H/L) | Image durability | Fluidity | Thermal fluidity | Transfer efficiency |
|---|---|---|---|---|---|---|---|---|---|
| Comparative Example 2 | 7.04 | 1.307 | 1.251 | X | X | X | Δ | X | X |
| Comparative Example 3 | 6.98 | 1.301 | 1.249 | X | X | X | ○ | Δ | X |

Referring to Tables 2 and 3, the electrophotographic toners according to the examples 1 to 3, which satisfy the conditions that an average circularity is about 0.960 to about 0.985, a coefficient of variation (C.V) of an average circularity is about 1.5% to about 3.3%, and a BET surface area is about 1.5 $m^2/g$ to about 3.5 $m^2/g$, exhibit improved results in terms of charging characteristic, image durability, fluidity, and transfer efficiency, compared to the comparative examples 1 to 3.

According to an embodiment of the present disclosure, a low molecular weight resin, which contributes to a minimum fixing temperature (MFT) and gloss, and a high molecular weight resin, which contributes to anti-offset and maintains an elasticity at a high temperature, are used together so that provided is a toner exhibiting a broad latex fixation region, no change of a fusing latitude according to a printing process speed. The toner also has a shape and a shape distribution which improve charging environmental stability, development durability, and image stability.

While the present disclosure has been particularly shown and described with reference to exemplary embodiments thereof, it will be understood by those of ordinary skill in the art that various changes in form and details may be made therein without departing from the spirit and scope of the present disclosure as defined by the following claims.

What is claimed is:

1. An electrophotographic toner comprising a binder with two resins having different weight average molecular weights, a coloring agent, and a release agent, wherein:

the toner comprises a ratio of sulfur strength [S] to iron strength [Fe] ([S]/[Fe]) measured by fluorescence x-ray in the toner is about $5.0\times10^{-4}$ to about $5.0\times10^{-2}$;

the toner has, on a Gel Permeation Chromatography (GPC) chromatogram, a molecular weight distribution curve including a main peak in a region of about $8.0\times10^3$ g/mol to about $4.0\times10^4$ g/mol and a shoulder starting point in a region of equal to or greater than about $1.0\times10^5$ g/mol;

the toner has a weight average molecular weight of about $5.0\times10^4$ g/mol to about $4.0\times10^5$ g/mol and a Z average molecular weight of about $1.0\times10^5$ g/mol to about $6.0\times10^6$ g/mol;

an average circularity of the toner is about 0.960 to about 0.985;

a coefficient of variation (C.V) of the average circularity of the toner is about 1.5% to about 3.3%; and the toner has a Brunauer, Emmett & Teller (BET) surface area of about 1.5 $m^2/g$ to about 3.5 $m^2/g$.

2. The toner of claim 1, wherein the toner further comprises about $1.0\times10^3$ ppm to about $1.0\times10^4$ ppm of iron (Fe) and about $1.0\times10^3$ ppm to about $5.0\times10^3$ ppm of silicon (Si).

3. The toner of claim 1, wherein a volume average particle diameter of the toner is about 4.0 μm to about 9.0 μm.

4. The toner of claim 1, wherein the toner has a GSDp value of about 1.0 to about 1.35 and a GSDv value of about 1.0 to about 1.3.

5. An electrophotographic toner comprising:

a primary binder agent comprising a low molecular weight resin latex having a weight average molecular weight of about $1.3\times10^4$ g/mol to about $3.0\times10^4$ g/mol and a high molecular weight resin latex having a weight average molecular weight of about $1.0\times10^5$ g/mol to about $5.0\times10^6$ g/mol;

a coloring agent to provide the toner with color;

a release agent adhered to the toner particles without being covalently bonded to the toner particles allowing the toner to be fused onto a final image receptor at a low fixation temperature; and a charging control agent allowing the toner to be supported on a developing roller;

wherein the ratio of the low molecular weight resin to the high molecular weight resin is about 80:20 to about 85:15;

wherein the toner comprises a ratio of sulfur strength [S] to iron strength [Fe] ([S]/[Fe]) measured by fluorescence x-ray in the toner is about $5.0\times10^{-4}$ to about $5.0\times10^{-2}$.

* * * * *